United States Patent [19]

Schmitmann

[11] 4,277,683

[45] Jul. 7, 1981

[54] X-RAY DIAGNOSTIC GENERATOR WITH A MEASURING ARRANGEMENT FOR THE X-RAY TUBE CURRENT

[75] Inventor: Herbert Schmitmann, Uttenreuth-Weiher, Fed. Rep. of Germany

[73] Assignee: Siemens Aktiengesellschaft, Berlin & Munich, Fed. Rep. of Germany

[21] Appl. No.: 83,300

[22] Filed: Oct. 10, 1979

[30] Foreign Application Priority Data

Nov. 17, 1978 [DE] Fed. Rep. of Germany ..... 2849979

[51] Int. Cl.[3] ..... H05G 1/00; H05G 1/30

[52] U.S. Cl. ..... 250/402; 250/416 R

[58] Field of Search ..... 250/402, 403, 405, 408, 250/409, 416 R

[56] References Cited

U.S. PATENT DOCUMENTS

| | | | |
|---|---|---|---|
| 3,783,287 | 1/1974 | Fulton et al. | 250/409 |
| 3,963,931 | 6/1976 | Shapiro | 250/416 R |
| 4,104,526 | 8/1978 | Albert | 250/403 |

*Primary Examiner*—Alfred E. Smith
*Assistant Examiner*—Janice A. Howell
*Attorney, Agent, or Firm*—Hill, Van Santen, Steadman, Chiara & Simpson

[57] ABSTRACT

The measuring arrangement contains a frequency converter which exhibits a light source which emits light pulses whose frequency corresponds to the x-ray tube current. A light conductor leads from the light source to an opto-electric transducer which is connected to an analog frequency meter and/or a pulse counter.

4 Claims, 1 Drawing Figure

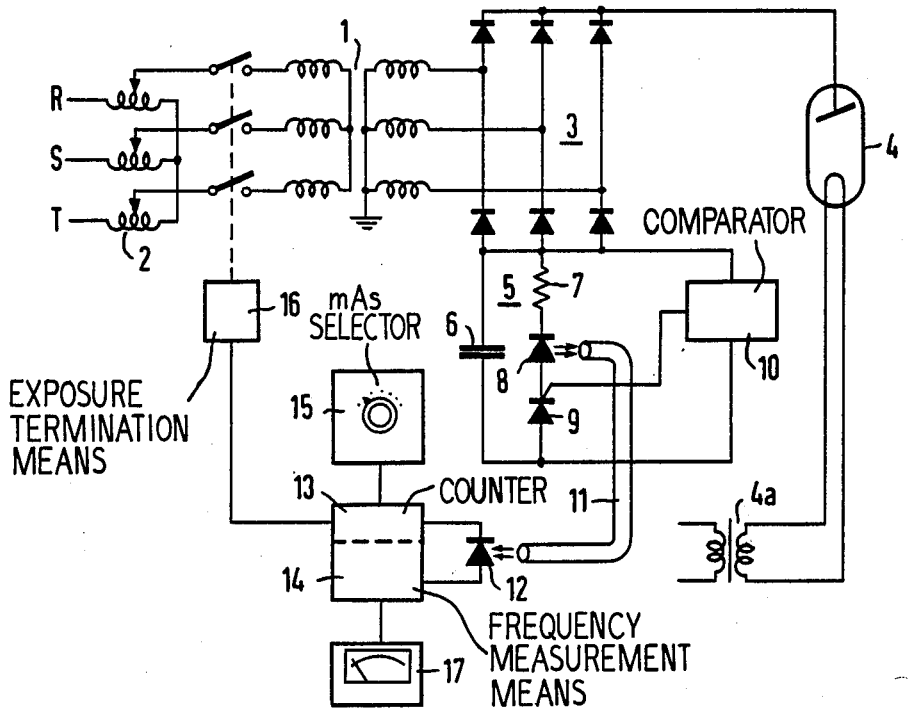
R
S
T
1
2
3
4
4a
5
6
7
8
9
10
11
12
13
14
15
16
17
COMPARATOR
mAs
SELECTOR
EXPOSURE
TERMINATION
MEANS
COUNTER
FREQUENCY
MEASUREMENT
MEANS

X-RAY DIAGNOSTIC GENERATOR WITH A MEASURING ARRANGEMENT FOR THE X-RAY TUBE CURRENT

BACKGROUND OF THE INVENTION

The invention relates to an x-ray diagnostic generator with a measuring arrangement for the x-ray tube current in the high voltage circuit.

It is known to provide two high voltage rectifiers in the high voltage circuit which are fed by a respective secondary winding group of the high voltage transformer and in whose connection line there lies a precision resistor at which a signal corresponding to the x-ray tube current is tapped. The use of two high voltage rectifiers as well as two secondary winding groups means a significant circuit-technical outlay. In order to reduce this outlay it is known to provide only one high voltage rectifier that is connected to one secondary winding group of a three-phase transformer and to connect the star point of the three-phase transformer to a precision resistor for the x-ray tube current via a further three-phase rectifier, which precision resistor is grounded at one end like the precision resistor in the prior art circuit initially cited. In the arrangement of a precision resistor in the star point of the three-phase high voltage winding of the high voltage transformer, the capacitance currents of the windings are also measured and must therefore be especially compensated.

SUMMARY OF THE INVENTION

The object of the invention is to create an x-ray diagnostic generator of the type initially cited which, given simple construction, allows of an interference-free current measurement in which, in particular, the capacitance currents of the windings are not also measured upon employment of a single three-phase secondary winding group of a three-phase high voltage transformer.

This object is inventively achieved in that the measuring arrangement contains a frequency converter which exhibits a light source that transmits light pulses whose frequency corresponds to the x-ray tube current and in that a light conductor leads from the light source to an opto-electric transducer which is connected to a frequency measurer and/or impulse counter. In the inventive x-ray diagnostic generator, the capacitance currents of the secondary winding or, respectively, of the secondary windings of the high voltage transformer have no influence on the result of the measurement. One can, therefore, make do with a single high voltage rectifier or, respectively, with a single high voltage rectifier bridge.

If a pulse counter is provided for sensing the x-ray tube current, then it is possible to allocate a selector to this pulse counter for setting a predetermined pulse member and to provide means for switching off the x-ray tube upon attainment of the pulse number set. In this case, the pulse counter with the selector functions as a mAs relay.

In the following, the invention is described in greater detail on the basis of an exemplary embodiment illustrated in the drawing; and other objects, features and advantages will be apparent from this detailed disclosure and from the appended claims.

BRIEF DESCRIPTION OF THE DRAWINGS

The single FIGURE shows a circuit diagram for illustrating an embodiment of the present invention.

DETAILED DESCRIPTION

A high voltage transformer 1 is illustrated in the drawing which is connected to a three-phase network via a regulating transformer 2 for adjusting the x-ray tube voltage. The secondary winding group of the high voltage transformer 1 has a three-phase high voltage rectifier 3 post-connected to it which supplies an x-ray tube 4. The filament current for the x-ray tube 4 is supplied by a filament transformer 4a whose primary winding is connected to the network via regulating means.

For sensing the x-ray tube current, a frequency converter 5 is provided in the high voltage circuit, which frequency converter 5 consists of a capacitor 6 as well as the series circuit lying parallel thereto and consisting of a resistor 7, a photodiode 8, and a thyristor 9. The thyristor is driven by a comparator 10 which compares the voltage across the capacitor 6 with a permanently programmed value.

The photodiode 8 is optically coupled via a light conductor 11 to a photodiode 12, which acts as an opto-electric transducer and drives both a counter 13 and a frequency measurer or a frequency meter 14. The counter 13 together with a mAs selector 15 forms a mAs relay that, upon attainment of a predetermined mAs product, actuates an exposure relay circuit 16 which terminates an x-ray exposure. The frequency measurer 14 controls a display device 17 for displaying the x-ray tube current.

The comparator 10 always triggers the thyristor 9 when the voltage at the capacitor 6 has achieved a predetermined value. Upon triggering, the capacitor 6 is discharged by the resultant conduction of the thyristor 9 through the circuit comprising the thyristor 9, the photodiode 8, and the discharging resistor 7. When the thyristor 9 is subsequently blocked again, then the capacitor 6 is recharged until it is again discharged by means of a new trigger pulse of the comparator 10. The frequency of the discharge processes and, thus, the frequency of the light pulses of the photodiode 8 depends on the magnitude of the x-ray tube current. The reading of counter 13 is a measure for the mAs product respectively achieved.

By means of the use of a light conductor, a potential separation between the high voltage circuit and low voltage circuit is achieved.

It will be apparent that many modifications and variations may be effected without departing from the scope of the novel concepts and teachings of the present invention.

I claim as my invention:

1. An x-ray diagnostic generator with a measuring arrangement for the x-ray tube current in the high voltage circuit, characterized in that the measuring arrangement comprises a frequency converter (5) having a light source (8) that emits light pulses whose frequency corresponds to the x-ray tube current, and an opto-electric transducer (12); and in that a light conductor (11) leads from the light source (8) to the opto-electric transducer (12), frequency measurement means being coupled with the opto-electric transducer (12) for providing a measure of x-ray tube current.

2. An x-ray diagnostic generator according to claim 1, characterized in that the frequency converter (5)

includes a capacitor (6) and a photodiode (8) connected therewith for emitting a light pulse upon attainment of a predetermined capacitor voltage whereby the capacitor (6) is simultaneously discharged.

3. An x-ray diagnostic generator according to claim 1, characterized in that said measurement means comprises a pulse counter (13) coupled with the opto-electric transducer (12) for counting pulses produced thereby in response to light pulses supplied thereto by means of said light conductor (11), a selector (15) for setting a predetermined pulse number, and means (16) connected to the pulse counter (13) for switching off the x-ray tube (4) when the pulse counter (13) reaches a count value corresponding to the pulse number set at said selector (15).

4. An x-ray diagnostic generator according to claim 2, characterized in that said measurement means comprises a pulse counter (13) coupled with said opto-electric transducer for counting pulses produced thereby in response to light pulses supplied thereto by means of said light conductor (11), a selector 15 for setting a predetermined pulse number, and means (16) connected to the pulse counter (13) for switching off the x-ray tube (4) when the pulse counter (13) reaches a count value corresponding to the pulse number set at said selector (15).

* * * * *